US005085274A

United States Patent [19]

Puri et al.

[11] Patent Number: 5,085,274

[45] Date of Patent: Feb. 4, 1992

[54] RECOVERY OF METHANE FROM SOLID CARBONACEOUS SUBTERRANEAN OF FORMATIONS

[75] Inventors: Rajen Puri; Dan Yee, both of Tulsa, Okla.

[73] Assignee: Amoco Corporation, Chicago, Ill.

[21] Appl. No.: 653,827

[22] Filed: Feb. 11, 1991

[51] Int. Cl.[5] ..... E21B 43/16; E21B 43/40

[52] U.S. Cl. ..... 166/252; 166/245; 166/263; 166/266; 166/269; 166/274

[58] Field of Search ..... 166/252, 251, 268, 269, 166/292, 294, 263; 299/10, 14

[56] References Cited

U.S. PATENT DOCUMENTS 4,283,089 8/1981 Mazza et al. ..... 299/16

4,833,122 11/1989 Puri et al. ..... 166/263

*Primary Examiner*—Stephen J. Novosad

*Attorney, Agent, or Firm*—Marcy M. Lyles

[57] ABSTRACT

A method of recovering methane from a solid carbonaceous subterranean formation includes injecting a gas that desorbs methane through an injection well into a subterranean formation and recovering methane from a first and a second production wells, or from a first and a second layer. Areal and/or vertical sweep efficiency of the injected desorbing gas can be increased by selectively restricting the flow of recovered fluids from the first or the second production well with the highest monitored ratio of injected desorbing gas. The restriction of flow forces the desorbing gas into higher permeability areas of the subterranean formation.

20 Claims, 2 Drawing Sheets

RECOVERY OF METHANE FROM SOLID CARBONACEOUS SUBTERRANEAN OF FORMATIONS

BACKGROUND OF THE INVENTION

1. Field of the Invention

The present invention relates to methods of recovering methane from solid carbonaceous subterranean formations and, more particularly, to methods of increasing the areal and/or vertical sweep efficiency of an injected desorbing gas.

2. Setting of the Invention

In recovering methane from solid carbonaceous material it is known to inject a gas or liquid into the subterranean formation to assist in desorbing methane from the solid carbonaceous material and to move the desorbed methane towards production wells. Ensuring that the injected gas or liquid contacts the solid carbonaceous material to the areal and/or vertical extent desired is very difficult. The volume of methane recovered can be increased if the injected gas or liquid can be directed towards certain areas and away from other areas in the subterranean formation. Injected gases or liquids pass preferentially through areas of higher permeability with subterranean formation, thereby leaving recoverable methane in areas of relatively lower permeability. This preferential passage is especially true in coal seams where the natural fractures in coal provide channels or relatively high permeability areas that are generally aligned or oriented in a single direction, so any injected gas or liquid passes relatively rapidly in that single direction with little to no contact with surrounding portions of the subterranean formation.

To assist the injected gas or liquid in passing through the areas of relatively lower permeability, various techniques have been used, including drilling a horizontal wellbore generally perpendicular to the aligned natural fractures in coal. One technique used as part of a hydraulic fracturing process is disclosed in Mazza, et al. U.S. Pat. No. 4,283,089, where $CO_2$ is injected into the coal seam to cause the coal to swell, thereby reducing the permeability of the coal adjacent the wellbore. Later, hydraulic fracturing fluid will pass preferentially into areas of the coal that have higher permeability than those areas of the coal that swelled.

SUMMARY OF THE INVENTION

The present invention is a method of recovering methane from a solid carbonaceous subterranean formation penetrated by an injection well and a first and a second production well. The method comprises the steps of injecting a gas into the subterranean formation through the injection well in a manner to cause adsorbed methane to be released and move towards the one or more production wells. Methane is recovered through the first and the second production wells, the ratio of the injected gas-to-methane is monitored at the first and the second production wells. If the monitored ratio or rate is higher for one production well than for another production well, then the flow of fluids recovered from the one production well is restricted.

This restriction results in a decrease in the recovery rate of fluids through the production well which causes a pressure differential in the subterranean formation. The desorbed methane and injected gas will pass through the subterranean formation towards areas of relatively lower pressure. This redirection of fluids permits the injected gas to contact areas of the subterranean formation that might have been bypassed previously, thereby resulting in an improvement in areal and/or vertical sweep efficiency of the injected gas, as well as an increase in the total quantity of methane recovered from the subterranean formation.

DETAILED DESCRIPTION OF THE PREFERRED EMBODIMENTS

Figure 1:
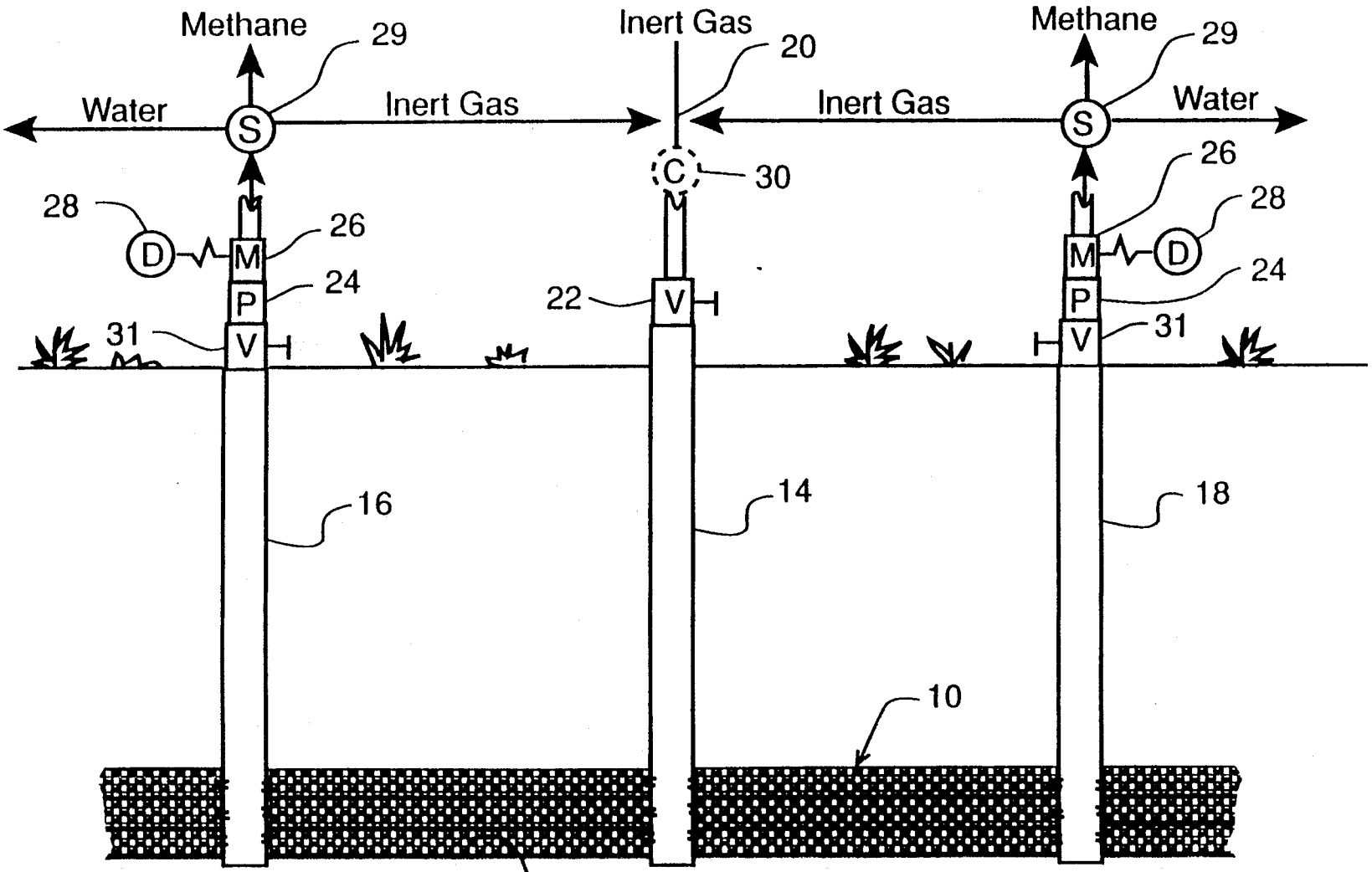
FIG. 1 is a cross-sectional view of an injection well and a first and a second production well penetrating a solid carbonaceous subterranean formation containing methane, and utilized in accordance with the present invention.

The present invention is a method of recovering methane from a solid carbonaceous subterranean formation penetrated by an injection well and one or more production wells. The preferred method comprises injecting a gas that desorbs methane into the solid carbonaceous subterranean formation through the injection well. The injected gas desorbs methane and moves the desorbed methane towards areas of relatively lower pressure surrounding wellbores of a first and a second production well which are used to recover fluids to the surface. A ratio of recovered injected gas-to-methane is monitored for at least the first and the second production wells, and if this ratio is greater than desired, such as greater for one production well than the other, then the injected gas may have passed through the subterranean formation to such production well through areas with relatively higher permeability. This preferential passage may have bypassed areas of the subterranean formation that have relatively lower permeability, which contain methane. To recover these additional quantities of methane, the flow of fluids recovered from such production well is restricted, which will create a zone of relatively higher pressure in the subterranean formation adjacent the wellbore of the production well. This increase in pressure will cause the injected gas to be redirected and move towards areas of relatively lower pressure in the subterranean formation, such as adjacent the wellbore of the other production well. This redirection of the injected gas through the subterranean formation to contact additional areas, which may have lower permeability, is referred to as improving the sweep efficiency of the injected gas. The areal sweep means the area in a generally horizontal plane that is affected, and the vertical sweep means the area in a generally vertical plane that is affected.

As used herein, the term "solid carbonaceous material" means any subterranean material that contains adsorbed natural gas, usually in the form of methane. Examples of such solid carbonaceous material can be any type of coal, gas shale, or the like.

As used herein, the term "gas that desorbs methane" means an essentially pure gas or a gaseous mixture that has as a major constituent a gas that causes methane to be displaced or stripped from the coal. Examples of such a gas include $CO_2$ and flue gas, as well as inert gases which (i) do not react with solid carbonaceous material in the subterranean formation under conditions of use (i.e., the standard meaning for "inert") and (ii) do not significantly adsorb to the solid carbonaceous material. For the purposes of the invention, inert gas is the preferred gas to be injected. Examples of such inert gases include nitrogen, helium, air and the like, and mixtures thereof. The injected gas that desorbs methane can be in the form of a liquid, such as liquid $CO_2$ or liquid nitrogen, and is injected into the subterranean formation where it will become a gas.

Essentially pure nitrogen is most preferred as the injected gas because of its relatively low adsorption capability to solid carbonaceous material, its current wide commercial availability, and relatively low cost. Ideally, the gas with the lowest adsorption capability is the most preferred, such as helium; however, the relatively high cost of field injection quantities of helium as compared to $CO_2$ or nitrogen can preclude its use as the major gas constituent throughout the life of the methane recovery project.

To assist in the understanding of the present invention reference is made to FIG. 1 where a subterranean formation 10 comprising one or more stratas or layers 12 of solid carbonaceous material, such as coal or gas shale, is penetrated by an injection well 14 and a first production well 16 and a second production well 18. It should be understood that in a field project for the recovery of methane several injection wells 14 will be used with several production wells 16, 18 each spaced from the injection wells 14, as is well known to those skilled in the art. The wells 14, 16 and 18 are shown as being vertical, cased and perforated; however, the wells can be vertical, inclined or horizontal, and can be completed in any manner desired, as is well known in the art. In one alternate preferred method, the injection well 14 is a well that was used as a production well in a pressure depletion methane recovery or other methane recovery process, but is now converted to an injection well with the removal of now unsuitable production surface control equipment and the addition of suitable surface control equipment for gas or liquid injection, as is well known to those skilled in the art.

In accordance with the preferred method of the present invention, a gas that desorbs methane from a source (not shown) passes through operatively connected surface piping 20 through a fluid flow restriction device, such as a valve 22, and downwardly through the wellbore of the injection well 14 and out into the subterranean formation 10. The gas is injected in a manner to cause methane to be desorbed and to be moved towards the areas of relatively low pressure surrounding the wellbores of the operating first and second production wells 16, 18. This manner of gas injection comprises injecting the gas preferably below the fracture pressure of the subterranean formation as measured at the wellbore of the injection well 14 adjacent the subterranean formation, and with a volume and for a duration to treat or contact a desired area of the subterranean formation with the injected gas. The injection pressures, volume and duration are selected by those skilled in the art. One method that can be utilized is disclosed in Chew U.S. Pat. No. 4,400,034, which is herein incorporated by reference.

As the injected desorbing gas passes through the subterranean formation 10, fluids, such as methane and water, are pushed towards areas of relatively lower pressure caused by the operation of downhole or surface pumps 24 withdrawing fluids through the first and the second production wells 16 and 18.

Once the fluids, such as methane, water and desorbing gas, have been recovered to the surface, the recovered fluids are passed to one or more separation units 29. Each separation unit 29 can comprise one or more commercially available separation units, such as water-gas separators, membrane separator units for the separation of methane from other fluids, and the like. Separated methane can be further processed, if desired, and transported for marketing. The separated desorbing gas is vented to the atmosphere, but is preferably recycled by passing the desorbing gas, through a compressor 30 if desired, back to the injection well 14 and back into the subterranean formation 10.

As the fluids are recovered to the surface through the first and the second production wells 16 and 18, commercially available measurement or monitoring devices 26 are utilized to determine gas ratio of recovered desorbing gas-to-methane for the first and the second production wells 16 and 18. As an alternative, the ratio of recovered water-to-recovered desorbing gas or water-to-recovered methane can be monitored and utilized. Also, the recovery rate of methane, water or desorbing gas, or combinations of these, such as total fluid recovery rate, can be monitored. The term ratio can be understood to also include the numerical values of flow rate, volume, partial pressure of one or more of the recovered fluids for comparison to a predetermined acceptable range of values, or value limits for that well or in comparison to one or more wells. The monitored ratios can be displayed on a commercially available display device 28, such as a CRT, pie chart recorder, bar graph, audio and/or visual alarm unit, or a representative signal can be transmitted to remote monitoring and control station, all as are well known to those skilled in the art. The monitored ratios are then used as described below.

For illustrative purposes, in FIG. 1 the subterranean formation 10 between the injection well 14 and the first production well 16 has a higher permeability than between the injection well 14 and the second production well 18, thus injected desorbing gas will tend to pass more quickly to the first production well 16 as compared to the second production well 18. In this case, a disproportionate volume of the desorbing gas will pass to the production well 16 without extending out into the subterranean formation over the areal and/or vertical extent and for as long of a period of time as desired. Therefore, recoverable methane will remain in the subterranean formation.

If the monitored gas ratio for the first production well 16 is outside of a desired range of values or an absolute value, or is greater than the ratio of the second production well 18, the flow of fluids from the first production well 16 is restricted in accordance with preferred methods of the present invention described below.

The fluid restriction can be accomplished by operating a valve 31 on the first production well 16 to partially restrict the flow of recovered fluids, such as a reduction of about 80% to about 10% of the previous flow rate of recovered fluids or selected individual components, such as methane and a desorbing gas. The valve 31 can be operated to completely restrict the flow of fluids, i.e., shut-in the first production well 16. It should be understood that the procedure of restricting flow of fluids from a production well, such as the first production well 16 in this example, also includes decreasing the volume and/or the flow rate of one or more selected injected fluid components. Also, the procedure of restricting the flow of fluids also includes increasing the flow of fluids recovered from one or more other production wells by more fully opening a valve 31 on the second production well 18 alone or in combination with opening and closing of the valve 31 on the first production well 16. Also, one or more injection wells 14 can be converted into production wells 16/18, and one or more production wells 16/18 can be converted into injection wells 14 to assist in restricting the flow of fluids or redirecting the flow of fluids in the subterranean formation. A requirement of this procedure is that by whatever means, i.e., opening or closing of the valves 31 or other means described below, the flow of fluids within the subterranean formation be redirected away from areas of relatively higher permeability and into areas of relatively lower permeability.

The restriction of the flow of fluids from the production wells 16 can last from several hours to a few days, or it can last for the duration of the methane recovery project. Further, the subterranean formation can be subjected to a huff-and-puff procedure where the pressure is measured at the wellbores adjacent the subterranean formation, and the flow of fluids is restricted from all or a majority of production wells while continuing the injection of the desorbed gas. Then, the pressure can be reduced by the opening of the valves 31 on one or more production wells. This huff-and-puff procedure can last for a few hours to several months, or can last until a measured bottomhole pressure at a first and a second production well meets or exceeds a desired pressure value.

For example, if a monitored ratio of the volume of desorbing gas-to-methane for the first production well 16 increases from essentially 0.1, i.e., little to no recovered desorbing gas as compared to the quantity of water and/or methane recovered, to greater than about 1:1 within about seven (7) days then breakthrough of the desorbing gas has occurred and the flow of fluids is restricted in accordance with the present invention. Also for example, if the monitored ratio for the first production well 16 is greater than the monitored ratio for the second production well 18 by a factor of about 30% then breakthrough has occurred and the flow of fluids is restricted in accordance with the present invention.

Other preferred methods of restricting the flow of fluids can include the introduction of one or a combination of flow restricting materials and fluids into the subterranean formation 10 adjacent the wellbore of one or more selected production wells. The flow restricting materials can be a single gas or liquid or a combination of fluids that causes solid carbonaceous material to swell, such as gas or liquid carbon dioxide. The flow restricting material can be a single gas or liquid or a combination of fluids that damage the cleat structure of the solid carbonaceous material, such as organic liquids and solvents including acetone, pyridene or diesel oil. Further, the flow restricting material can be a single gas, liquid or material or combinations of these that blind or plug the pore spaces of the solid carbonaceous material. Examples of such flow restricting materials include commercially available lost circulation materials, polymers, surfactant foams, epoxies, and cement. Also, cement can be injected into the subterranean formation adjacent one or more selected production wells. Combinations of fluids that damage the permeability of the solid carbonaceous material, i.e., swell, blind or plug the solid carbonaceous material, can be used. The injection pressures of the flow restricting material are preferably above, but can be below, the fracture pressure of the subterranean formation so the restricting material will be forced out into the relatively high permeability areas of the subterranean formation adjacent the wellbore(s) and out into the subterranean formation. Also, the manner of operation, the quantity of materials used, and the number and location of wells so treated can be developed by those skilled in the art, for example, by the well service industry that offers well services on a commercial basis for oil and gas wells.

Once the flow of recovered fluids from the selected one or more production wells has been restricted by any of the above-described procedures, the movement of fluids within the subterranean formation is redirected so that the injected and desorbed fluids bypass the relatively higher pressure areas adjacent the wellbores of the restricted production wells. These fluids will then flow to a greater areal and/or vertical extent than what would occur without the above-described procedure towards areas of relatively lower pressure adjacent the wellbores of the unrestricted or less restricted one or more other production wells. In this manner, additional quantities of methane can be contacted by the injected gas, desorbed, and recovered than what could be recovered without the practice of the preferred methods of the present invention.

Figure 2:
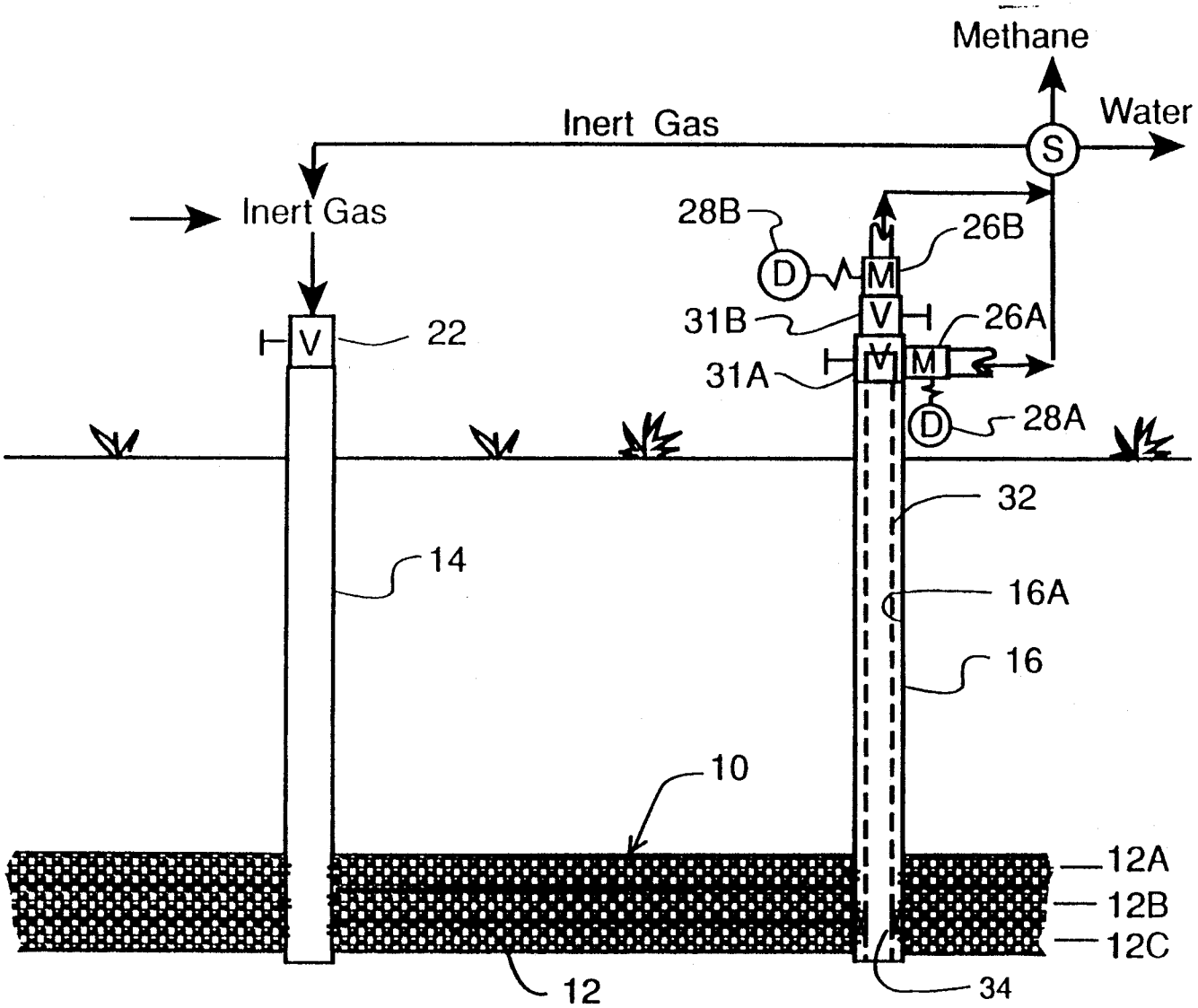
FIG. 2 is a cross-sectional view of an injection well and a production well penetrating a multilayered solid carbonaceous subterranean formation containing methane, and utilized in accordance with the present invention.

The above-described preferred methods can also be used when one or more formations or layers 12 of the solid carbonaceous material has a greater permeability than other adjacent formations or layers penetrated by the same wellbore. For example, in FIG. 2, one or more layers 12 of the subterranean formation 10 is penetrated by the injection well 14. A production well 16 includes internal tubing 32 operatively in communication with layer 12C, but is separated from the annulus 16A of the production well 16 and thus the layers 12A and 12B by a packer 34. The use of such tubing 32 and packer 34 are well known to those skilled in the art. The production well 16 also includes two commercially available monitors 26A and 26B with displays 28A and 28B operatively connected through valves 31A and 31B to the tubing 32 or the annulus 16A, as is desired and as described previously.

If, for example, layer 12C has a relatively higher permeability than layers 12A and 12B, then either monitor 26A or 26B detects an absolute value or a difference in valves when the ratio of recovered desorbing gas-to-methane exceeds a desired limit or a relative value as compared to the value from the adjacent layers and/or from adjacent production wells. At that time, the flow of fluids from the relatively higher permeability layer 12C is restricted by any of the preferred methods of the present invention described above to assist in redirecting the flow of the desorbing gas.

Whereas, the present invention has been described in particular relation to the above-described example and attached drawings, it should be understood that other and further modifications, apart from those shown or suggested herein, may be made within the scope and spirit of the present invention.

What is claimed is:

1. A method of recovering methane from a solid carbonaceous subterranean formation penetrated by an injection well and first and second production wells, the method comprising the steps of:

(a) injecting a gas that desorbs methane into the subterranean formation through the injection well in a manner to cause methane to be described and move towards first and second production wells;

(b) monitoring a ratio of injected desorbing gas-to-methane recovered form the first and the second production wells; and (c) restricting a flow of recovered fluids from the first or the second production well with the highest monitored ratio.

2. The method of claim 1 wherein the injected desorbing gas comprises a gas having nitrogen as a major constituent.

3. The method of claim 1 wherein step (c) further comprises shutting in the first or the second production well with the highest monitored ratio.

4. The method of claim 1 wherein step (c) further comprises introducing a flow restricting material or fluid into the subterranean formation adjacent a wellbore of the first or the second production well with the highest monitored ratio.

5. The method of claim 4 wherein the flow restricting material or fluid is selected from the group consisting of carbon dioxide, acetone, pyridene, diesel oil, lost circulation material, polymers, epoxy, surfactant, foam, cement and mixtures thereof.

6. A method of recovering methane from a solid carbonaceous subterranean formation penetrated by an injection well and first and second production wells, (a) injecting a gas that desorbs methane into the subterranean formation through the injection well in a manner to cause methane to be desorbed and move towards the first and the second production wells;

(b) monitoring the rate of recovery of injected desorbing gas for the first and the second production well; and (c) restricting a flow of recovered fluids from the first or the second production well with the highest monitored recovery rate of injected desorbing gas.

7. The method of claim 6 wherein step (c) further comprises shutting in the first or the second production well with the highest monitored recovery rate of injected desorbing gas.

8. The method of claim 6 wherein step (c) further comprises shutting in the first or the second production well with the highest monitored recovery rate of injected desorbing gas.

9. The method of claim 6 wherein step (c) further comprises introducing a flow restricting material or fluid into the subterranean formation adjacent a wellbore of the first or the second production well with the highest monitored recovery rate of injected desorbing gas.

10. The method of claim 9 wherein the flow restricting material or fluid is selected from the group consisting of carbon dioxide, acetone, pyridene, diesel oil, lost circulation material, polymers, epoxy, surfactant, foam, cement, and mixtures thereof.

11. A method of recovering methane from a solid carbonaceous subterranean formation having a first layer and a second layer, both layers being penetrated by an injection well and one or more production wells, the method comprising the steps of:

(a) injecting a gas that desorbs methane through the injection well into the first layer and the second layer of the subterranean formation;

(b) monitoring a ratio of injected desorbing gas-to-methane recovered from the first and second layers of the subterranean formation through a first and a second production well; and (c) restricting a flow of recovered fluids from the first layer or the second layer of the subterranean formation with the highest monitored ratio.

12. The method of claim 11 wherein the injected desorbing gas comprises a gas having nitrogen as a major constituent.

13. The method of claim 11 wherein step (c) further comprises ceasing the flow of fluids from the first layer or the second layer with the highest monitored ratio.

14. The method of claim 11 wherein step (c) further comprises introducing a flow restricting material or fluid into the first layer or the second layer with the highest monitored ratio.

15. The method of claim 14 wherein the flow restricting material or fluid is selected from the group consisting of carbon dioxide, acetone, pyridene, diesel oil, lost circulation material, polymers, epoxy, surfactant, foam, cement and mixtures thereof.

16. A method of recovering methane from a solid carbonaceous subterranean formation having a first layer and a second layer, both layers being penetrated by an injection well and one or more production wells, the method comprising the steps of:

(a) injecting a gas that desorbs methane through the injection well into the first layer and the second layer of the subterranean formation;

(b) monitoring a rate of recovery of injected desorbing gas for the first and second layers of the subterranean formation; and (c) restricting a flow of recovered fluids from the first or second layer with the highest monitored recovery rate of injected desorbing gas.

17. The method of claim 16 wherein the injected desorbing gas comprises a gas having nitrogen as a major constituent.

18. The method of claim 16 wherein step (c) further comprises ceasing the flow of fluids from the first layer or the second layer with the highest monitored recovery rate.

19. The method of claim 16 wherein step (c) further comprises introducing a flow restricting material or fluid onto the first layer or the second layer with the highest monitored recovery rate.

20. The method of claim 19 wherein the flow restricting material or fluid is selected from the group consisting of carbon dioxide, acetone, pyridene, diesel oil, lost circulation material, polymers, epoxy, surfactant foam, cement and mixtures thereof.

* * * * *

UNITED STATES PATENT AND TRADEMARK OFFICE

CERTIFICATE OF CORRECTION

PATENT NO. : 5,085,274

DATED : February 4, 1992

INVENTOR(S) : Rajen Puri

It is certified that error appears in the above-identified patent and that said Letters Patent is hereby corrected as shown below:

On the Title page, in the Title, line 2, "of" should be deleted.

Column 7, line 3, "described" should read --desorbed--.

Signed and Sealed this

Eighth Day of June, 1993

*Attest:*

Michael K. Kirk

MICHAEL K. KIRK

*Attesting Officer*

*Acting Commissioner of Patents and Trademarks*